US005777541A

United States Patent [19]

Vekeman

[11] Patent Number: 5,777,541

[45] Date of Patent: Jul. 7, 1998

[54] MULTIPLE ELEMENT PTC RESISTOR

[75] Inventor: Guy O. A. Vekeman, Gent, Belgium

[73] Assignee: U.S. Philips Corporation, New York, N.Y.

[21] Appl. No.: 692,144

[22] Filed: Aug. 5, 1996

[30] Foreign Application Priority Data

Aug. 7, 1995 [EP] European Pat. Off. ..... 95202149

[51] Int. Cl.[6] ..... H01C 7/10

[52] U.S. Cl. ..... 338/22 R

[58] Field of Search ..... 338/22 R, 116, 338/307, 319, 320, 328, 332; 219/505

[56] References Cited

U.S. PATENT DOCUMENTS

| | | | |
|---|---|---|---|
| 3,824,328 | 7/1974 | Ting et al. | 174/52 PW |
| 4,246,468 | 1/1981 | Horsma | 338/22 R |
| 4,315,237 | 2/1982 | Middleman et al. | 338/22 R |
| 4,357,590 | 11/1982 | Belhomme | 338/23 |
| 4,504,817 | 3/1985 | Shikama et al. | 338/23 |
| 5,064,997 | 11/1991 | Fang et al. | 338/22 R |
| 5,142,267 | 8/1992 | Fellner et al. | 338/23 |
| 5,471,034 | 11/1995 | Kawate et al. | 219/48 J |
| 5,493,266 | 2/1996 | Sasaki et al. | 338/22 R |

FOREIGN PATENT DOCUMENTS

| | | |
|---|---|---|
| 952011443 | 5/1995 | European Pat. Off. . |
| 4230848 | 9/1992 | Germany . |
| 3215354 | 9/1991 | Japan . |
| 3215355 | 9/1991 | Japan . |
| 3215356 | 9/1991 | Japan . |
| 4170360 | 6/1992 | Japan . |
| 4170361 | 6/1992 | Japan . |
| 6302404 | 10/1994 | Japan . |

*Primary Examiner*—Edward Tso

[57] ABSTRACT

A two-terminal resistor (2) having a positive temperature coefficient of resistivity, comprised of a plurality of disc-shaped resistive elements (1) which are arranged and held together in a stack, whereby: each resistive element (1) has two oppositely-situated principal surfaces (3), each of which is metallised substantially in its entirety; a metallic arm (7) is situated between each pair of adjacent resistive elements (1), and is soldered to a principal surface (3) of each element (1) in the pair; a metallic arm (7') is soldered to the terminating principal surface (3') at each end of the stack; part of each metallic arm (7, 7') protrudes outward beyond the boundary of the stack; the protruding parts of the metallic arms (7, 7') with an even ordinal (n=2,4,6) are rigidly connected to a first terminal (**9*a*), and the protruding parts of the metallic arms (7, 7') with an odd ordinal (n=1,2,3) are rigidly connected to the second terminal (9*b***).

20 Claims, 3 Drawing Sheets

MULTIPLE ELEMENT PTC RESISTOR

BACKGROUND OF THE INVENTION

The invention relates to a two-terminal resistor having a Positive temperature Coefficient of resistivity (PTC).

Such a device comprises a body of material whose electrical resistivity increases as a function of temperature. This characteristic places a natural upper limit on the electrical current which can be passed through the body, since the ohmic heating accompanying current-flow causes an increase in the body's electrical resistance, with an attendant reduction in conductance. As a result, PTC resistors lend themselves to application in, for example, overload protection devices and (self-resetting) electrical fuses; in addition, they can be used as compact electrical heating elements.

An important application of PTC resistors is in the degaussing circuit of a colour Cathode Ray Tube. Such a tube is generally fitted with a large coil (degaussing coil) through which an alternating current can be passed, thereby generating an alternating magnetic field which serves to demagnetise the tube's shadow mask. Such demagnetisation in turn reduces colour defects in the tube picture. In general, a PTC resistor is connected in series with the degaussing coil, so that the magnitude of the current supplied to the coil rapidly decays from an initial maximum value (the so-called inrush current) to a significantly lower residual value (usually zero). As a rule, the obtained degaussing effect is best when the current-amplitude decays in an approximately linear fashion.

PTC materials which are widely used in the art include certain semiconductor ceramic compositions (such as doped $BaTiO_3$) and polymers (e.g. a mixture of high-density polyethene, ethene copolymer and carbon black: see U.S. Pat. No. 4,315,237). In a typical PTC resistor, a disc-shaped body of such material is provided on each of its two principal surfaces with an electrode layer, to which a metallic terminal is subsequently soldered; see, for example, U.S. Pat. Nos. 3,824,328 and 5,142,267. Such a disc-shaped resistor demonstrates a characteristic resistance R at each given temperature, whose value places an upper limit on the obtainable current-flow through the resistor at that temperature, thereby restricting the suitability of the resistor for certain applications. In particular, the resistor's room-temperature resistance (the so-called cold resistance, $R_{25}$) limits the value of the inrush current.

A number of recent trends in the television industry require the development of PTCs with higher inrush currents and a slower current-decay. Such trends include:

- The increasing popularity of the 16:9 screen aspect ratio;
- The evolution away from PAL and NTSC standards, and towards $D^2MAC$, for example;
- The introduction of HDTV, with its higher pixel density and scan rate.

An elementary way to reduce R (and thus $R_{25}$, in particular) would be to make the PTC disc thinner, thereby increasing the disc's conductance in the direction perpendicular to its principal surfaces, and consequently increasing the current i through the disc at a given voltage v. However, such a measure also increases the degree of ohmic heating of the disc, which is determined by the product vi. In addition, since the volume of the disc is decreased, its heat capacity C will also decrease. The combined effect of these last two phenomena is a considerable increase in the heating rate of the resistor, and, therefore, an unfavourable reduction of the switching duration. The increased heating rate may, in turn, cause damage to the disc.

An alternative approach is to increase the diameter of the disc at a given thickness. This, however, causes the overall lateral dimensions of the disc to increase significantly, which is undesirable in view of the continuing drive towards miniaturisation. In addition, since the heat capacity is hereby increased, the disc as a whole is made less sensitive, since a given quantity of internal ohmic heat will now produce a smaller temperature increase, and thus a smaller resistance change.

Yet another approach is to decrease the electrical resistivity of the PTC material in the disc. This, however, is extremely difficult, since the number of practical PTC materials currently in use is very limited, and the allowed degree of doping of such materials is also restricted (in view of other required properties of the final PTC material, such as its switching temperature).

SUMMARY OF THE INVENTION

It is an object of the invention to provide a two-terminal PTC resistor whose cold resistance $R_{25}$ is significantly lower than that of conventional PTC resistors of approximately the same dimensions. In addition, it is an object of the invention that the heat capacity of the inventive PTC resistor should be of the same order of magnitude as that of a conventional PTC resistor of approximately the same dimensions. It is also an object of the invention that the design of the new PTC resistor should make it highly tailorable to the exact individual requirements of various applications.

These and other objects are achieved in a two-terminal resistor having a positive temperature coefficient of resistivity, characterised in that the resistor is comprised of a plurality of disc-shaped resistive elements which are arranged and held together in a stack, whereby:

- each resistive element has two oppositely-situated principal surfaces, each of which is metallised substantially in its entirety;
- a metallic arm is situated between each pair of adjacent resistive elements, and is soldered to a principal surface of each element in the pair;
- a metallic arm is soldered to the terminating principal surface at each end of the stack;
- part of each metallic arm protrudes outward beyond the boundary of the stack;
- the protruding parts of the metallic arms with an even ordinal are rigidly connected to a first terminal, and the protruding parts of the metallic arms with an odd ordinal are rigidly connected to the second terminal.

The term "disc-shaped" as here employed should not be interpreted as referring exclusively to circular-cylindrical bodies; rather, the term is intended to encapsulate any three-dimensional geometrical form having two oppositely-located principal surfaces, regardless of the shape of their perimeters. Examples of such forms include rectangular blocks, polygonal slices, parallelipipids, etc. The stipulation that each principal surface should be metallised "substantially in its entirety" should here be interpreted as implying that the metallised portion of each principal surface should constitute at least 90%, preferably in excess of 95%, and ideally 100% (or a value close thereto), of the surface area of the principal surface concerned. The reason for this stipulation will be discussed later.

The individual disc-shaped resistive elements in the inventive PTC resistor are electrically connected in a parallel configuration. If it is assumed that this configuration contains a plurality n of identical circular resistive elements, each having a radius r and a thickness t/n, then the resultant resistance of the stack will be $R/n^2$, where R is the resistance of a single disc-shaped body of the same material, having a radius r and a thickness t; the PTC resistor according to the invention therefore demonstrates a drastically lower electrical resistance than a monolithic PTC resistor of approximately the same global dimensions. On the other hand, the volume of PTC material in the inventive resistor is $n\times(\pi r^2\times t/n)=\pi r^2 t$, which is the same as the volume of the said monolithic PTC resistor; consequently, the heat capacity of the inventive PTC resistor is approximately the same as that of the monolithic resistor. However, because the inventive PTC resistor is subdivided into a plurality of relatively thin discs, it dissipates ohmic heat more efficiently than a monolithic resistor.

In particular, because the inventive PTC resistor is comprised of several distinct resistive elements, its physical characteristics can be accurately tailored to the particular requirements of a given application, by appropriate choice of the thickness and material constitution (e.g. degree and type of doping) of each individual resistive element in the stack. For example, by embodying the resistive elements to have successively higher switching temperatures (Curie temperatures) and electrical resistivities, the current-decay in the inventive PTC becomes more drawn out. This is caused by the fact that, as the first resistive element becomes high-ohmic, there is still a low-ohmic shunt around it, which will itself become high-ohmic at a later stage (higher temperature). If this shunt is comprised of more than one resistive element, then the current-decay through the whole stack can become considerably drawn out.

In this light, a particularly simple and attractive embodiment of the resistor according to the invention is characterised in that it contains only two resistive elements, one of which has both a higher electrical resistivity and a higher switching temperature than the other. Such an embodiment is not to be confused with a so-called "duo-PTC", which is a three-terminal series-connected pair of PTC resistive elements, as described in U.S. Pat. No. 4,357,590, for example.

In a particular embodiment of the resistor according to the invention, the resistive elements are predominantly comprised of $(Ba:Sr:Pb)TiO_3$, with the additional presence of at least one donor dopant and at least one acceptor dopant. Compared to the known PTC polymers, such ceramic materials are easier to metallise, and they are less susceptible to thermal deformation at the relatively high operating temperatures characteristic of PTC resistors (often of the order of 150°–200° C.). Suitable donor dopants include, for example, Sb, Nb, Y, and many of the Lanthanides; on the other hand, Mn is an exemplary acceptor dopant. In a particularly satisfactory embodiment prepared by the inventors, antimony oxide (donor) and manganese oxide (acceptor) were employed in a ratio 3:1 and in a cumulative quantity less than 1 mol.%. The adjustability of the atomic ratio Ba:Sr:Pb allows the electrical resistivity and switching temperature of the individual resistive elements to be tailored to particular requirements, thereby allowing different resistive elements in the stack to have mutually differing physical properties.

A preferential embodiment of the inventive PTC resistor is characterised in that each principal surface is metallised with a metal selected from the group consisting of Ag, Zn, Ni, Cr, and their alloys. These metals demonstrate good adhesive properties, particularly when applied to the class of materials discussed in the previous paragraph, but also when applied to other ceramic compositions and polymer PTC materials. In addition, they demonstrate a relatively low sheet resistivity, a high corrosion-resistance, and good solderability.

As discussed in non-prepublished European Patent Application No. 95201144.3 (PHN 15.292), insufficient metallisation of the principal surfaces of a resistive element can cause differential heating effects within the element. These effects can, in turn, produce mechanical stresses which may lead to cracking or complete breakage of the element. Metallisation of the principal surfaces can be conducted with the aid of, for example, sputter deposition, vapour deposition or laser ablation deposition. However, it is preferable to use a screen printing procedure for this purpose, since this generally results in a more complete coverage (~100%) of the principal surfaces, without attendant metallisation of the side surfaces of the resistive elements (and the associated risk of short-circuiting).

Suitable metals from which the metallic arms can be made include phosphor-bronze, tin, stainless steel, brass, and copper-aluminium. These metals have a relatively low electrical resistivity, can readily be bent when in thin-sheet form, and demonstrate good solderability. It is not necessary that all the metallic arms be of the same material constitution, or that they have the same geometrical form or dimensions. In addition, if so desired, more than one metallic arm may be employed between any given pair of adjacent resistive elements, or at a terminating principal surface at an end of the stack.

An advantageous embodiment of the resistor according to the invention is characterised in that the metallic arms are reflow-soldered to the principal surfaces using a Pb—Sn—Ag alloy. A suitable example of such an alloy is $Pb_{50}Sn_{46.5}Ag_{3.5}$, for example. An advantage of such alloys is that they have a relatively high melting point (of the order of 200°–210° C. for the quoted composition), so that they are resilient to the relatively high operating temperatures characteristic of a PTC resistor (e.g. 150°–180° C.). Reflow-soldering is particularly suited to the current invention, because it allows (parts of) the metallic arms to be coated with solder alloy prior to assembly of the stack of resistive elements; once the stack is assembled, the resistive elements can then be soldered in place simply by heating the whole stack, e.g. in an oven. This obviates the need to individually access each of the closely-spaced discs with a soldering iron.

If so desired, one may use an electrically conductive adhesive to attach the resistive elements to the metallic arms. This, however, is generally more expensive than soldering, and requires an adhesive having a relatively high melting point.

In another advantageous embodiment of the inventive PTC resistor, each terminal comprises an elongated metallic ribbon which has been subdivided at one edge into a number of mutually parallel longitudinal strips, each strip being bent out of the plane of the ribbon at a different longitudinal position so as to form a metallic arm. Such an embodiment obviates, for example, the need to solder the various metallic arms to a supporting columnar terminal, and provides the required interconnection of the resistive elements using a minimum of material. The accompanying drawings depict two particular versions of this embodiment (FIGS. 3 and 4).

BRIEF DESCRIPTION OF THE DRAWINGS

The invention and its attendant advantages will be further elucidated with the aid of exemplary embodiments and the accompanying schematic drawings, not all of uniform scale, whereby.

It should be noted that corresponding features in the different Figures are denoted by the same reference symbols.

DETAILED DESCRIPTION OF PREFERRED EMBODIMENTS OF THE INVENTION

Embodiment 1

Figure 1:
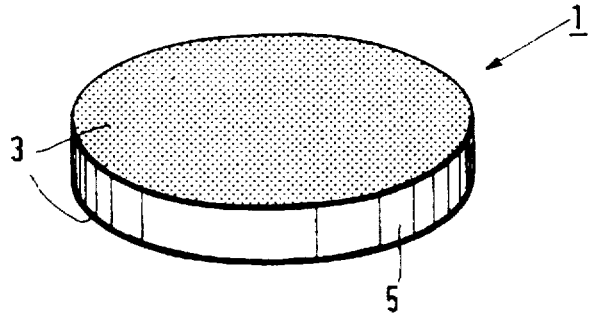
FIG. 1 renders a perspective view of a disc-shaped PTC resistive element having metallised principal surfaces.
Figure 2:
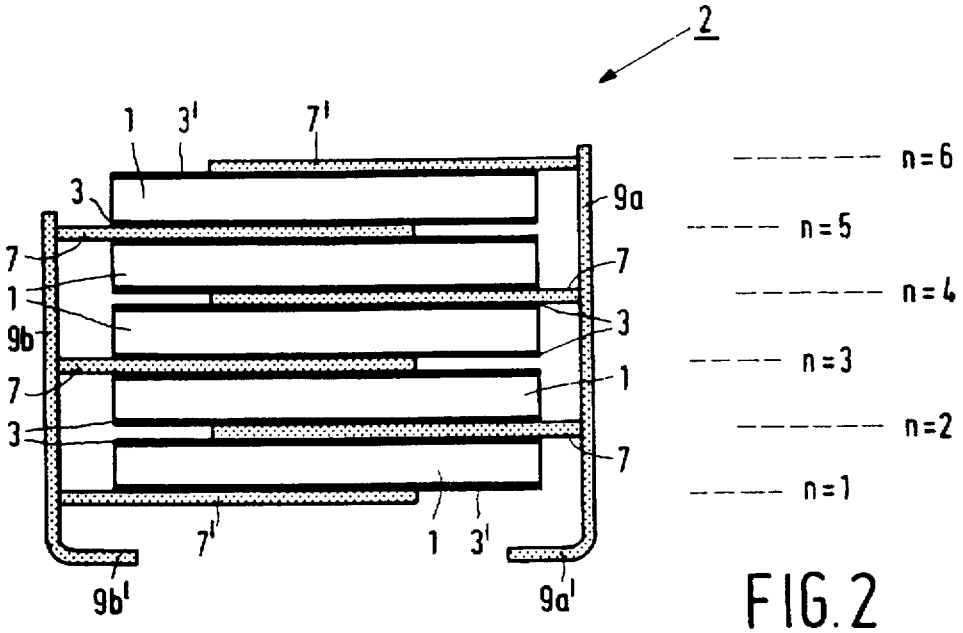
FIG. 2 is an elevational view of a two-terminal PTC resistor according to the invention, comprising a stack of resistive elements of the type depicted in FIG. 1.

FIGS. 1 and 2 pertain to a particular embodiment of a two-terminal PTC resistor in accordance with the invention.

FIG. 1 shows a disc-shaped resistive element 1 which is comprised of material demonstrating a Positive Temperature Coefficient of resistivity (PTC). The particular element 1 shown here is circular-cylindrical, and has two oppositely-situated (circular) principal surfaces 3 and a (cylindrical) side surface 5. The diameter of the surfaces 3 is 12 mm, and the thickness of the element 1 is 1 mm.

Each of the two principal surfaces 3 is metallised in its entirety, i.e. it is completely covered by a layer of metal of substantially uniform thickness (typically of the order of 2–3 μm in the case of evaporated layers, and 10 μm in the case of screen-printed layers). On the other hand, the side surface 5 is substantially un-metallised, or, in any case, is free of any tract of metal which might cause short-circuiting of the two surfaces 3.

In a particular embodiment, the element 1 is comprised of $Ba_{0.85}Sr_{0.115}Pb_{0.035}TiO_3$, with the additional presence of approximately 0.24 mol. % $Sb_2O_3$ and 0.08 mol. % $MnCO_3$ (before sintering). Its resistivity at room temperature (25° C.) is approximately 1 Ωm. Furthermore, the principal surfaces 3 are metallised with a silver alloy containing approximately 6 wt. % Zn, provided with the aid of a screen-printing procedure (see, for example, the above-cited non-prepublished European Patent Application No. 95201144.3).

FIG. 2 shows a two-terminal PTC resistor 2 according to the invention. The resistor 2 is comprised of a stack of five of the resistive elements 1 depicted in FIG. 1. A metallic arm 7 is situated between each pair of adjacent resistive elements 1, and is soldered to the neighbouring principal surface 3 of each element 1 in the pair. In addition, a metallic arm 7' has been soldered to the terminating principal surface 3' at each end of the stack, i.e. to the topmost and bottommost principal surface in FIG. 2.

Each of the metallic arms 7, 7' protrudes outward beyond the boundary of the stack, i.e. over the perimeter of adjacent elements 1. The protruding parts of the metallic arms 7, 7' with an even ordinal n=2,4,6 are rigidly connected to a first terminal 9a, whereas the protruding parts of the metallic arms 7, 7' with an odd ordinal n=1,3,5 are rigidly connected to the second terminal 9b.

The terminals 9a, 9b may be embodied, for example, as metallic rods or plates to which the metallic arms 7, 7' are soldered. Alternatively, use can be made of a supporting structure such as that depicted in FIGS. 3 and 4, wherein the metallic arms are bent out of a sheet of metal which then serves as a terminal.

To facilitate surface-mounting on a printed circuit board (PCB), one extremity of each of the terminals 9a, 9b has been bent inward to form a foot 9a', 9b', respectively. However, it is also possible to hole-mount the resistor 2 on a PCB, e.g. by narrowing an extremity of each of the terminals 9a, 9b into a thin finger-like form.

In a particular embodiment, the metallic arms 7, 7' and terminals 9a, 9b have a sheet-thickness of approximately 0.2 mm, and are made of a phosphor-bronze alloy (e.g. having an approximate composition 94 at. % Cu, 5.9 at. % Sn, 0.1 at. % P). The arms 7, 7' are reflow-soldered to the metallised principal surfaces 3, 3' at approximately 250° C. using a $Pb_{50}Sn_{46.5}Ag_{3.5}$ alloy. To this end, the arms 7, 7' are pre-coated (e.g. using a brush or squeegee) with a molten mixture of the said solder alloy, a flux solution and an activator, according to well-known practice in the art.

Assuming R to denote the electrical resistance of a cylindrical monolithic PTC resistor of diameter 12 mm and thickness 5 mm, and having the ceramic composition given above, then the particular inventive resistor 2 described here has a resistance value $R/(5)^2=R/25$. Yet, such a monolithic resistor has substantially the same dimensions as the said inventive resistor.

Embodiment 2

Figure 3:
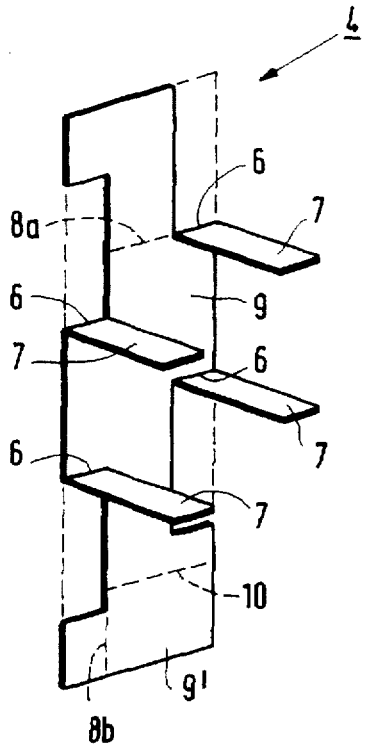
FIG. 3 is a perspective depiction of a metallic terminal with protruding metallic arms, suitable for use in the inventive PTC resistor.
Figure 4:
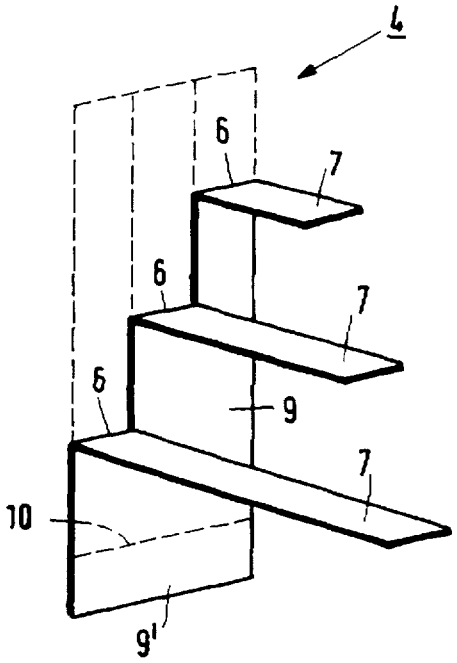
FIG. 4 is a perspective depiction of a another metallic terminal with protruding metallic arms, also suitable for use in the PTC resistor according to the invention.

FIGS. 3 and 4 show different specific embodiments of supporting structures 4 which are suitable for use in a PTC resistor according to the invention. Each structure 4 is manufactured by bending metallic arms 7 out of the plane of a thin metallic sheet 9, according to a specific pattern.

The starting product for manufacture of the structure 4 in FIG. 3 is an elongated metal ribbon 9, in this case a rectangle measuring 10 mm×3 mm and having a sheet-thickness of 0.3 mm. In a first manufacturing step, both long edges of this ribbon 9 are subdivided into a series of mutually parallel longitudinal strips 7, i.e. elongated strips 7 whose long axis is parallel to the long edge of the ribbon 9. This is achieved, for example, with the aid of spark erosion, or a wire saw, laser beam or water jet, whereby narrow L-shaped tracts are cut inwards from the long edges of the ribbon 9. These L-shaped tracts outline rectangular strips 7, each of which lies within the plane of the ribbon 9 and is attached thereto along a short edge 6. As here depicted, each of the strips 7 is rectangular, measuring approximately $2.0\times1$ mm$^2$.

In a subsequent manufacturing step, each of the said rectangular strips 7 is bent out of the plane of the ribbon 9, by hinging it about its edge 6. Once this bending step has been enacted, each strip 7 serves as a metallic arm and the ribbon 9 serves as a terminal (in the context of the PTC resistor according to the invention). Needless to say, the mutual separation and length of the arms 7 can be tailored to the diameter and thickness of the resistive elements 1 intended for use in the inventive PTC resistor 2. Similarly, the number of arms 7 can be tailored to the planned number of resistive elements 1 in the resistor 2.

If so desired, the terminal 9 can be trimmed down to a more compact size by cutting along the lines 8a, 8b, so as to remove excess sheet material. In addition, the terminal 9 may be bent along the line 10, so as to create a foot 9' which facilitates surface-mounting of the terminal 9 on a PCB.

FIG. 4 shows a supporting structure 4 which is different to that depicted in FIG. 3. Starting with the same elongated metallic ribbon 9, the strips 7 are now cut into a short edge of the ribbon, to successively greater depths. Each such strip 7 is then bent out of the plane of the ribbon 9, by hinging it about the edge 6 which connects it to the ribbon 9.

Once this bending step has been enacted, each strip 7 serves as a metallic arm and the ribbon 9 serves as a terminal (in the context of the PTC resistor according to the invention). The various metallic arms 7 are of mutually different length, but can be shortened to a uniform length if so desired. In addition, the terminal 9 may be bent along the line 10, so as to create a foot 9' which facilitates surface-mounting of the terminal 9 on a PCB.

Embodiment 3

Figure 5:
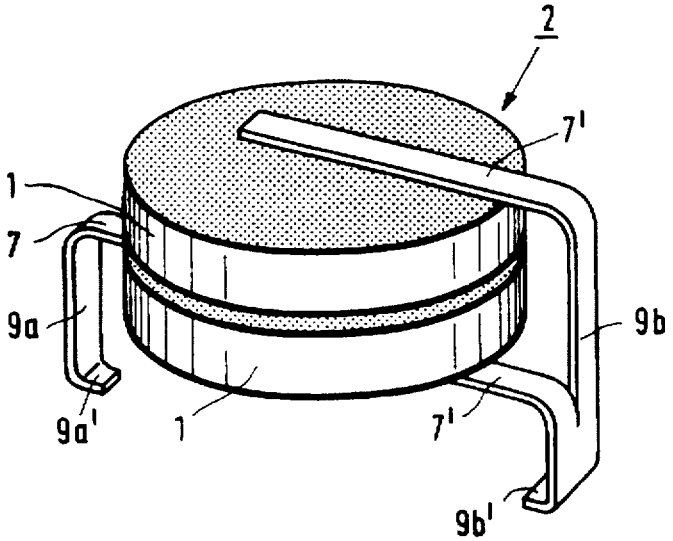
FIG. 5 renders a perspective view of a particular embodiment of the inventive PTC resistor.

FIG. 5 is a perspective view of a PTC resistor 2 in accordance with the invention, comprising two resistive elements 1 which are enclosed in a metallic supporting structure 7, 7', 9*a*, 9*b*. One of the elements 1 has the approximate composition $(Ba_{0.74}Sr_{0.172}Pb_{0.042}Ca_{0.046})$—$TiO_3$, yielding a Curie temperature $T_c$ of 70° C., and the other element 1 has the approximate composition $(Ba_{0.74}Sr_{0.12}Pb_{0.094}Ca_{0.046})TiO_3$, with $T_c$=95° C. The cold resistances $R_{25}$ of these elements 1 are 20 Ω and 32 Ω, respectively.

Figure 6:
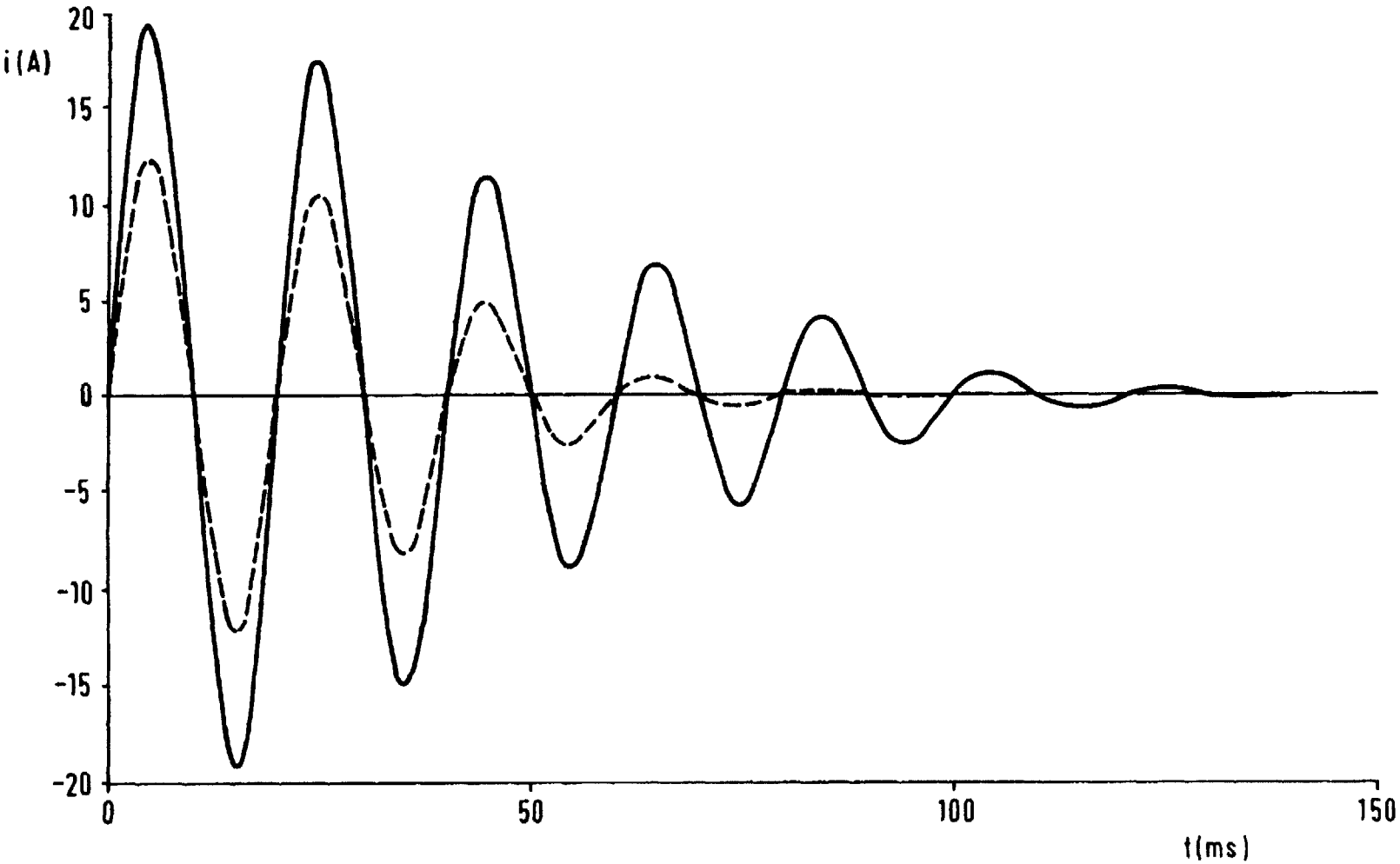
FIG. 6 is a graph of current versus time for the subject of FIG. 5, as compared to a known PTC resistor.

FIG. 6 graphically depicts the value of an alternating current i through the resistor 2 in FIG. 5 as a function of time t (solid line), as compared to a known PTC resistor (broken line). The known PTC resistor is a Philips type 2322 662 96016, with $T_c$=75° C. and $R_{25}$=24 Ω.

From the graph, it is immediately evident that the inventive PTC resistor has a larger inrush current and a slower current-decay than the known PTC resistor.

I claim:

1. A two-terminal resistor having a positive temperature coefficient of resistivity, characterised in that the resistor is comprised of a plurality of disc-shaped resistive elements which are arranged and held together in a stack, whereby:

each resistive element has two oppositely-situated principal surfaces, each of which is metallised substantially in its entirety;

a metallic arm is situated between each pair of adjacent resistive elements, and is soldered to a principal surface of each element in the pair;

a metallic arm is soldered to the terminating principal surface at each end of the stack;

part of each metallic arm protrudes outward beyond the boundary of the stack;

the protruding parts of the metallic arms with an even ordinal are rigidly connected to a first terminal, and the protruding parts of the metallic arms with an odd ordinal are rigidly connected to the second terminal; and moving successively from the resistive element on one side of the stack to the resistive element on the opposite side of the stack, each resistive elements in the stack has a higher switching temperature and electrical resistivity than the preceding resistive element in the stack.

2. A two-terminal resistor according to claim 1, characterised in that the resistive elements are predominantly comprised of $(Ba:Sr:Pb)TiO_3$, with the additional presence of at least one donor dopant and at least one acceptor dopant.

3. A two-terminal resistor according to claim 1 wherein each principal surface is metallised with a metal selected from the group consisting of Ag, Zn, Ni, Cr, and their alloys.

4. A two-terminal resistor according to claim 1, wherein each metallic arm is comprised of a metal selected from the group consisting of phosphor-bronze, tin, stainless steel, brass, and copper-aluminium.

5. A two-terminal resistor according to claim 1, wherein the metallic arms are reflow-soldered to the principal surfaces using a Pb-Sn-Ag alloy.

6. A two-terminal resistor according to claim 1, wherein each terminal comprises an elongated metallic ribbon which has been subdivided at one edge into a number of mutually parallel longitudinal strips, each strip being bent out of the plane of the ribbon at a different longitudinal position so as to form a metallic arm.

7. A two-terminal resistor according to claim 1, wherein it contains only two resistive elements, one of which has both a higher electrical resistivity and a higher switching temperature than the other.

8. A two-terminal resistor according to claim 2, wherein each principal surface is metallised with a metal selected from the group consisting of Ag, Zn, Ni, Cr, and their alloys.

9. A two-terminal resistor according to claim 2, wherein each metallic arm is comprised of a metal selected from the group consisting of phosphor-bronze, tin, stainless steel, brass, and copper-aluminium.

10. A two-terminal resistor according to claim 3, wherein each metallic arm is comprised of a metal selected from the group consisting of phosphor-bronze, tin, stainless steel, brass, and copper-aluminium.

11. A two-terminal resistor according to claim 8, wherein each metallic arm is comprised of a metal selected from the group consisting of phosphor-bronze, tin, stainless steel, brass, and copper-aluminium.

12. A two-terminal resistor according to claim 2, wherein the metallic arms are reflow-soldered to the principal surfaces using a Pb—Sn—Ag alloy.

13. A two-terminal resistor according to claim 11, wherein the metallic arms are reflow-soldered to the principal surfaces using a Pb—Sn—Ag alloy.

14. A two-terminal resistor according to claim 2, wherein each terminal comprises an elongated metallic ribbon which has been subdivided at one edge into a number of mutually parallel longitudinal strips, each strip being bent out of the plane of the ribbon at a different longitudinal position so as to form a metallic arm.

15. A two-terminal resistor according to claim 13, wherein each terminal comprises an elongated metallic ribbon which has been subdivided at one edge into a number of mutually parallel longitudinal strips, each strip being bent out of the plane of the ribbon at a different longitudinal position so as to form a metallic arm.

16. A two-terminal resistor according to claim 2, wherein it contains only two resistive elements, one of which has both a higher electrical resistivity and a higher switching temperature than the other.

17. A two-terminal resistor according to claim 3, wherein it contains only two resistive elements, one of which has both a higher electrical resistivity and a higher switching temperature than the other.

18. A two-terminal resistor according to claim 4, wherein it contains only two resistive elements, one of which has both a higher electrical resistivity and a higher switching temperature than the other.

19. A two-terminal resistor according to claim 14, wherein it contains only two resistive elements, one of which has both a higher electrical resistivity and a higher switching temperature than the other.

20. A two-terminal resistor according to claim 15, wherein it contains only two resistive elements, one of which has both a higher electrical resistivity and a higher switching temperature than the other.

* * * * *